United States Patent [19]

McManus

[11] 4,056,908

[45] Nov. 8, 1977

[54] COMPOSITE CONCRETE SLAB AND STEEL JOIST CONSTRUCTION

[76] Inventor: Ira J. McManus, 39 Lincoln Ave., Florham Park, N.J. 07940

[21] Appl. No.: 602,711

[22] Filed: Aug. 7, 1975

[51] Int. Cl.[2] ..... E04B 5/16; E04C 3/20

[52] U.S. Cl. ..... 52/334; 52/335; 52/694

[58] Field of Search ..... 52/334–337, 52/326, 27, 719, 694

[56] References Cited

U.S. PATENT DOCUMENTS

| | | | |
|---|---|---|---|
| 1,434,915 | 11/1922 | Scholfield | 52/719 |
| 1,804,132 | 5/1931 | Tashjian | 52/335 |
| 1,828,078 | 10/1931 | Sealey | 52/337 |
| 1,898,736 | 2/1933 | Melvin | 52/335 |
| 2,477,394 | 7/1949 | Spiker | 52/694 |
| 3,094,813 | 6/1963 | Saxe | 52/344 |
| 3,307,304 | 3/1967 | Klausner | 52/326 |
| 3,362,121 | 1/1968 | Weber | 52/694 |
| 3,527,007 | 9/1970 | McManus | 52/327 |
| 3,683,580 | 8/1972 | McManus | 52/334 |
| 3,728,835 | 4/1973 | McManus | 52/334 |

*Primary Examiner*—James L. Ridgill, Jr.

*Attorney, Agent, or Firm*—James J. Cannon, Jr.; James J. Cannon

[57] ABSTRACT

A composite action open-web steel joist, supporting beams and girders, and reinforced concrete slab interconnection. Upper apex portions of the steel joist webbing protrude through the upper chord members of the joist, and through apertures provided in the sheet metal formwork placed over such joists prior to the pouring of the concrete slab. The improvement relates to a continuous round rod secured near the apex of each projecting web member parallel to the longitudinal axis of the joist and a reinforcing wire mesh draped between said rods, thus permitting greater spacing between said joists, whereby said protruding apex portions, said rods and said draped wire mesh will be encased within the slab to act as shear interconnection and reinforcement devices therein, to secure the joist and formwork together, to enhance the locking of the concrete slab to the protruding joist apex portions, and to the supporting beams through the joist end connection welded to the beam or girder, and to reinforce said concrete slab. This improvement makes optional the use of wedge members forced between such protruding joist apex portions.

5 Claims, 5 Drawing Figures

COMPOSITE CONCRETE SLAB AND STEEL JOIST CONSTRUCTION

BACKGROUND OF THE INVENTION

1. Field of the Invention

This invention pertains to concrete and steel construction, and is directed particularly to composite open-web steel joist and wire mesh reinforced concrete slab construction to provide a more rigid and more economical composite floor or roof structure in building construction as compared to prior art construction.

2. Background of the Invention

The improvement in this application pertains specifically to an improvement in the composite concrete slab and steel joist construction disclosed in U.S. Pat. No. 3,728,835, of the same inventor. It also relates to other patents covering elements of a composite beam and joist floor system including U.S. Pat. Nos. 3,392,499; 3,457,818; 3,527,007; 3,624,980; 3,683,580 and copending application Ser. No. 491,696.

Specifically the system disclosed in these prior patents provided for composite action between a poured-in-place concrete slab and open-web steel joists utilizing apertured sheet metal formwork members in association with open-web steel joists, the upper apex portion of the zig-zag webbing of which projected through the upper joist chords so as to project through the formwork openings and act as sheer members in the hardened concrete slab thereafter poured. This system included wedge means for interlocking the protruding apex shear portions of the joist webbing with respect to the sheet metal formwork, thereby eliminating the need for welding such sheet metal formwork to the joist chords.

The present invention represents an improvement over the prior art system, particularly as disclosed U.S. Pat. No. 3,782,835, in that it provides for a continuous round rod being secured to the apex of each joist web projection longitudinally along each joist. Under some design conditions this rod will perform all or most of the functions performed by the wedge means in the prior patent. Additionally the rod serves as a support means for draping a wire reinforcing mesh between joists for reinforcement of the concrete slab. By draping the mesh from rod to rod, the mesh will be near the top of the concrete slab over the joists and near the bottom of the slab midway between joists. The draping use of the wire mesh greatly adds to the strength of the concrete slab and enables joists to be spaced further apart. Both improvements result in lower material and erection costs.

SUMMARY OF THE INVENTION

This invention pertains to improvements in composite concrete slab and steel open-web joist construction. Open-web joists are fabricated with a pair of angle irons welded opposedly along and a short distance below the apices of the upper side of a zig-zag, bent-rod web to form the top chord of a joist, while similar angle irons are welded along the apices on the bottom side of the bent-rod web to form a bottom chord. Thus, web apex portions project upwardly above the angle irons along the top chord. The joists so fabricated are supported at each end by the beams. Preferably such end connections will be made in accordance to the methods and means of the above-cited prior patents, further including the disclosure of a flanged edge pan having a locking tab. The flanged edge is supported by a rod which lies across the upper chord of the joists. The opposite edge rests upon the supporting beam. The pan is secured to the rod and locked in place by bending the tab around the support rod with finger pressure. Thus the concrete launches down on the beam encasing the joist ends, with the hardened concrete acting as the top flange of the composite beam.

The corrugated sheet metal formwork placed upon the installed joists has rectangular apertures spaced at regular intervals corresponding with the apex-to-apex spacing of the bent-rod web portion of the joist to provide for the projection therethrough of said upper apex portions. After a concrete slab is poured and hardens, there results a composite action between the slab and the open-web steel joists, the upwardly projecting and embedded apex portions of the steel joist webbings serving as shear devices encased within the concrete. Composite action is thus effected between the slab and the open-web steel joists, resulting in a stiffer and stronger roof or floor construction. The composite structure also permits lighter weight steel construction of the open-web steel joists for more economical construction.

A bent steel metal wedge is utilized in this system of construction to supplement or replace welding of the joists to the sheet metal formwork, which formwork can be rigidly secured to the joists by hammering these tapered wedges within and between the steel joist apex portions and the upper surfaces of the framework. The wedges are the key to making the joist composite as they act to lock the sheet metal formwork in place and subsequently bond the concrete to the joists. The action of the wedges also minimizes concrete leakage and further enhances the keying action between the concrete slab and the joist because of the additional concrete surrounding and within the wedging device.

The specific improvements disclosed herein relate to a means which, depending upon design and construction criteria, can either replace or enhance the function performed by the wedging devices, can provide a stronger concrete slab composite action, and thus can make possible a greater span between joists, resulting in fewer joists and substantial economic savings in material and labor costs. The improvements relate to the use of a round reinforcing rod which is secured by welding or other means to each upper apex portion of the webbing along the longitudinal axis of each joist. A wire reinforcing mesh is then draped over said rods from joist to joist such that the wire mesh will be near the top of the concrete slab over each joist and near the bottom of each slab midway between joists.

Both the rods and the mesh serve to reinforce the concrete slab permitting a wider expanse between joists. This design, through the positioning of the wire mesh, uses the tensile strength of the mesh to the utmost by resisting the concrete slab negative bending moment over the joists, with the tension being at the top of the slab, and by resisting the slab positive bending moment midway between the two joists, with the tension being at the bottom of the slab. When the rod is placed continuously across the supporting beam or girder, the composite action between the supporting beam and the concrete slab, in conjunction with the flanged pan encasing the joist end assembly, is enhanced. Thus the combination of the prior art and improvements allows the entire system to support more construction load or dead load even before concrete is poured and composite action accomplished. After the concrete is poured, the rod and wire mesh improvements yield even greater composite action because of their interrelations and the resultant distribution of stress throughout the system.

The rods perform many of the functions of the wedge and permit the optional omission of the wedging device. The wedges may be loosely installed to support the rods until the rods are welded or otherwise secured in position, at which point the wedges may be removed. Alternately the wedges may be installed as heretofore and the rods simply laid between the upward extending portion of the wedge and the apex of the webbing. In this case the rods would be wired to the apex portion of the webbing, eliminating the onsite welding of the rods. All alternatives, however provide the advantges described above.

DESCRIPTION OF THE PREFERRED EMBODIMENT

Figure 1:
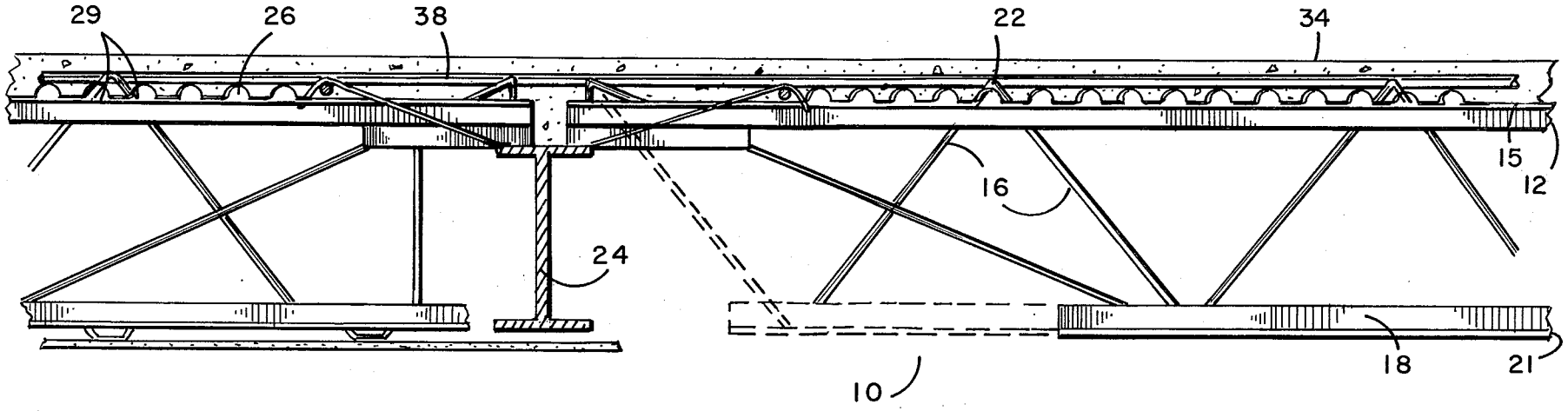
FIG. 1 is a partial vertical cross-sectional view illustrating one form of the improved composite concrete slab and steel joist construction showing the rod of the invention in position.
Figure 2:
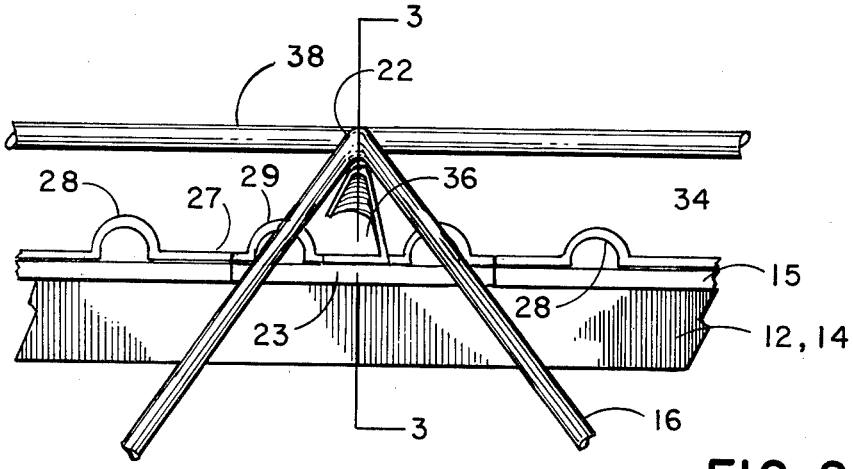
FIG. 2 illustrates, on an enlarged scale, a concrete embedded upper end portion of the steel joist webbing showing a modification of the invention illustrated in FIG. 1 including the use of a locking wedge to secure the rod to the apex of the joist webbing.

Referring now in detail to the drawings and in particular to FIGS. 1 and 2, reference numeral 10 designates an open-web steel joist comprised of a pair of angle irons 12, 14 (only one illustrated in FIG. 1), welded opposedly along and a short distance below the apices at the upper side of zig-zag bent-rod web 16 to form top chord 15 of the joist, and a pair of angle iron members 18, 20 (only one illustrated in FIG. 1), welded opposedly along the apieces at the other side, i.e. the bottom side, on bent web 16 to form bottom chord 21 of the joist. Joist 10 is thus formed along its length with web apex portion 22 projecting upwardly between angle irons 12, 14 comprising top chord 15. As shown in FIG. 1, the steel joists are adapted, in floor or roof construction, to be supported at each end upon girders or beams 24 (only one illustrated in FIG. 1). Preferably such end connections will be constructed according to the method and means described in my prior patents cited above, for improved composite end connections for steel joists with one exception being flanged-edge pan 25 which has a locking tab 26 at its midpoint in length between top chord 15 comprising joists 10. This improvement is best illustrated later in FIG. 5. The improved composite concrete slap and joist construction comprising the present invention is particularly well suited to use in the combination with the composite end connection for steel joists disclosed in said prior patents.

The corrugated sheet metal formwork 27 placed upon the installed joists is formed with the usual outwardly extending ribs 28 for rigidity in supporting the concrete slab to be poured. Corrugated sheetmetal formwork 27 has regularly spaced prepunched rectangular apertures 29, corresponding to the apex-to-apex spacing of the bent-rod web portion 16 of the steel joist 10. These apertures stamped in parallel, aligned rows along corrugated sheet metal formwork 27 provide substantially rectangular apertures 29 so spaced and arranged for the projection therethrough of the upwardly projecting apex portions 22 of bent rod web 16. After concrete slab 34 is poured and hardens, there results a composite action between the poured-in-place concrete slab 34, the open-web steel joist 10, and the upwardly projecting and embedded apex portion 22 of the steel joist webbing, which, in combination, serve as shear devices when encased within concrete slab 34. Composite action is thus effected between slab 34 and open-web steel joist 10 resulting in a stiffer and stronger floor and roof construction. This composite structure also permits lighter-weight steel construction of the open-web steel joists for more economical construction.

FIGS. 2, 3, 4 and 5 illustrate modifications and improvements of the prior patents. These Figures illustrate the use of bent sheet metal locking wedge devices 36, which were utilized in the prior U.S. Pat. No. 3,728,835, to supplement or entirely replace the usual procedure of welding the sheet metal formwork members 27 to open-web joists 10 prior to the pouring of concrete slab 34. As described in the prior patents, by using a hammer, wedges 36 were force-fitted in wedging position within and between the steel joist apex portions 22 and upper surface portions 23 of the sheet metal formwork members 27 to secure rigidly open-web joist 10 and the associated sheet metal formwork 27 together. Wedges 36, between the top chord angle irons 12, 14 of open-web steel joists 10 and immediately below the upwardly projecting apex portion 22 of bent rod web 16, cover aperture 29 of formwork 27 to minimize the possibility of concrete leakage therethrough upon the pouring of concrete slab 34. Wedges 36 also enhance the keying action between the concrete slab 34 and the joist 10 because of the additional concrete within and surrounding the devices.

One specific improvement illustrated in all the Figures is the installation of a reinforcing rod 38, at or near the tops of each apex portion 22 of bent rod webbing 16, extending lengthwise along the longitudinal axis of each joist 10. When welded into position, rods 38 serve to secure the joists 10 and enhance the keying action between the concrete slab 34, the joist 10, and webbing 16 because of the additional interaction of concrete surrounding rods 38.

Figure 3:
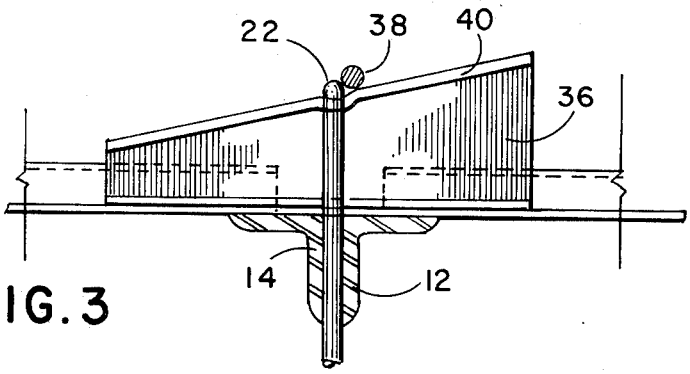
FIG. 3 is a cross-sectional view taken along the lines 3—3 of FIG. 2.

Thus with bent rod web 16 and rods 38 welded in place, wedges 36 may be removed and omitted. However, installation of rods 38 may be simplified by affixing rods 38 by wiring to web apex 22 with the same being strengthened by welding if desired. If this procedure is used, an appropriate means of covering aperture 29 is suggested. As an alternative method of installing rods 38 to eliminate the welding process, wedges 36 may be locked in position and rods 38 laid across the wedges 36 between webbing apex portions 22 and upward extending portion 40 of wedges 36. The alternatives are illustrated in FIGS. 2 and 3.

Figure 4:
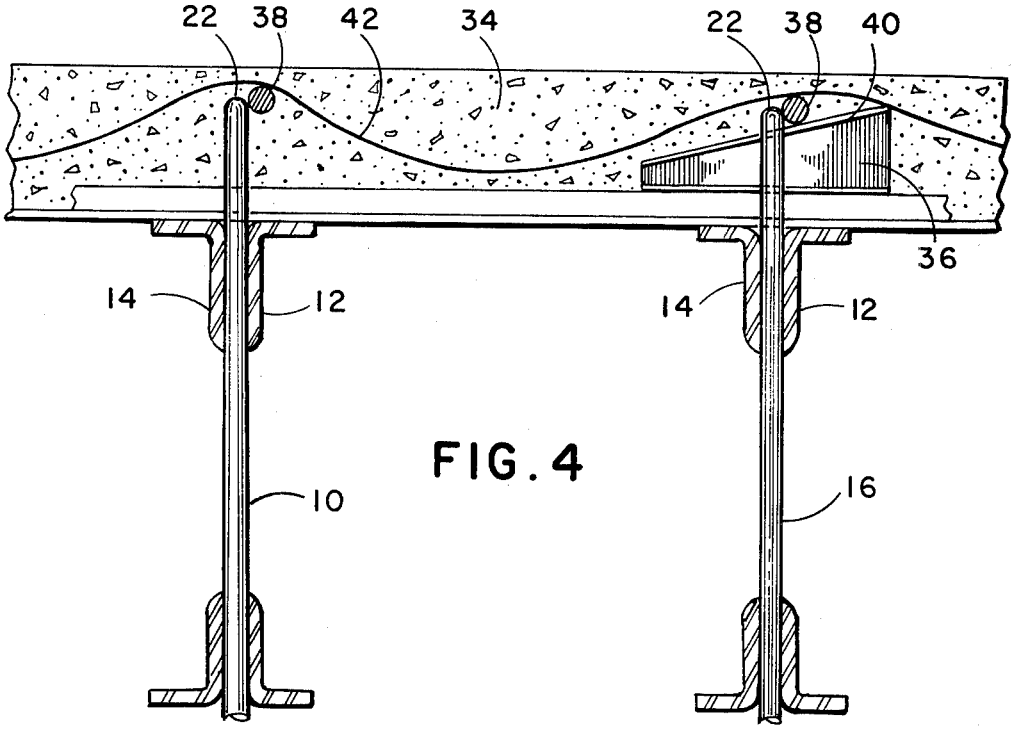
FIG. 4 is a cross-sectional view of the wire mesh embedded in a concrete slab.
Figure 5:
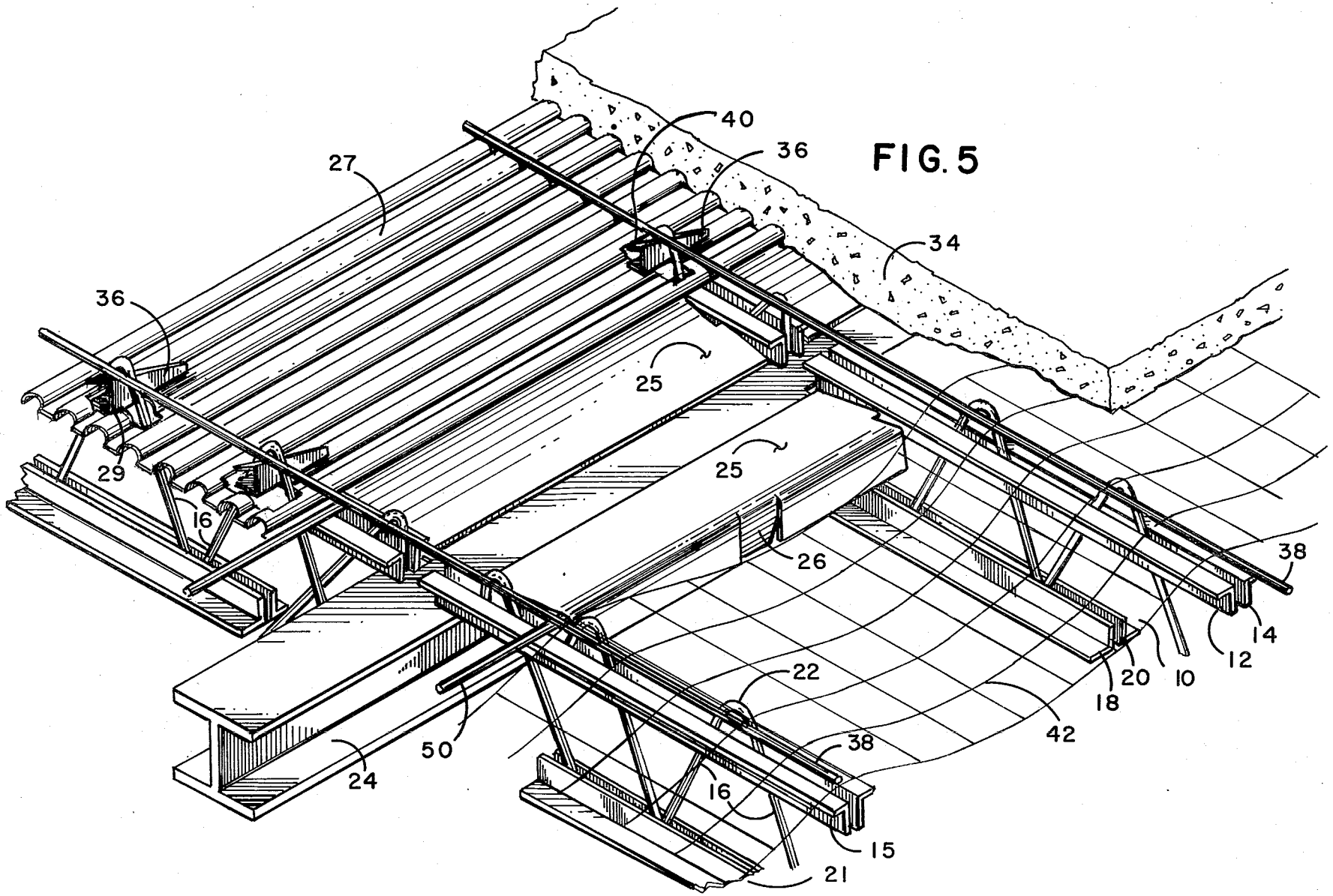
FIG. 5 is a side perspective view partially cut away illustrating the draping of the wire mesh of the invention in conjunction with the improvements of the present invention.

FIGS. 4 and 5 illustrate each alternative and a further improvement in this construction technique utilizing rods 38. By placing rod 38 continuously across supporting beam 24, the composite action between the same is enhanced allowing support of more construction or dead load. Also in these Figures there is illustrated a wire mesh 42 which is draped over rods 38 on parallel, regularly spaced-apart joists 10. In the draping position, best illustrated in FIG. 4, wire mesh 42 is closest to the top of concrete slab 34 where it is supported by rods 38 over joists 10 and is lowest in concrete slab 34 midway between two parallel joists 10. Wire mesh 42 serves to further reinforce concrete slab 34, thus providing additional strength to slab 34 by resisting and counteracting the bending moments of concrete slab 34. This positioning of wire mesh 42 uses the tensile strength of the mesh to the utmost by resisting the concrete slab negative bending moments over the joists 10 and by resisting the positive moments midway between the joists 10.

As illustrated in FIG. 5 flanged-edge rectangular pan 25, supported by beam 24 and by rod 50 which spans across top chord 15, is locked into position by bending precut tab 26 around rod 50. Thus the interrelation of supported flanged-edge pan 25, which allows concrete slab 34 to encase chords 15 and joists 10 supporting continuously extending rod 38 and wire mesh 42, produces composite action beyond that of the prior art. Thus slab 34 is strengthened by distributing stress so that joists may be spaced further apart. This results in a significant savings of material and labor costs.

While I have illustrated and descirbed herein several forms in which my invention may be conveniently embodied in practice, it is to be understood that these forms are presented by way of example only and not in a limited sense. The invention, in brief, includes all the modifications and embodiments coming within the scope and spirit of the following claims.

I claim:

1. In a composite open-web steel joist and concrete slab construction, the combination comprising:

at least one open-web joist member having a zig-zag bent metal webbing member, and secured top and bottom chords; said zig-zag bent rod webbing member having a substantially uniformly spaced series of upper extending apex portions with respect to the said top chord to which it is affixed forming a plurality of shear members extending upwardly from said chord at said portions; a corrugated solid sheet metal formwork member having a substantially flat top and bottom portions received in seating engagement upon said joist top chord and having a plurality of apertures therein for the through passage of said upwardly extending shear members;

said top chord being displaced somewhat downwardly from the upper ends of said apex portions of said bent rod web and being secured to said webbing members and acting in combination with said apex portions as shear members in said composite steel joist and concrete slab construction;

a rod affixed to the apices of said shear members and extending along the longitudinal axis of said joists; and a wire mesh draped over one or more of said rods prior to pouring concrete such that said wire mesh is near the top of the concrete when poured over said joists and is near the bottom of said slab midway between any two of said joists such that said wire mesh serves to reinforce the concrete when poured; and wedge means securing said apex portions with respect to said corrugated metal formwork member;

said wedge means comprising an angular bent piece of sheet metal including an upwardly extending leg having tapered edge portions supported by said bottom leg portion defining a substantially triangular shaped cross-section wedge means;

a poured concrete slab upon said formwork members and encasing said shear members, said rod, and said mesh.

2. The composite open-web steel joist and concrete slab construction as described in claim 1 wherein said rod is affixed to said apex portions by welding it in place.

3. The composite open-web steel joist and concrete slab construction as described in claim 1 wherein said rod is placed between the upwardly extending portion of said wedge and said apex portion of said joist webbing attached to said apex portion by wires.

4. The composite open-web steel joist and concrete slab construction as described in claim 1 wherein said rod is placed between the upwardly extending portion of said wedge and said apex portion of said joist webbing and attached to said apex portion by wires.

5. The composite open-web steel joist and concrete slab construction as described in claim 1 further including:

a flanged edge pan positioned between said top chords and resting upon said structural beam and a rod spanning said top chords;

a pre-cut tab at the midpoint in length of flanged edge being bent around said rod to secure the same.

* * * * *